US006132062A

United States Patent [19]

Borders et al.

[11] Patent Number: 6,132,062

[45] Date of Patent: Oct. 17, 2000

[54] TASK LIGHT FOR A SURGICAL LIGHT APPARATUS

[75] Inventors: Richard L. Borders, Cincinnati, Ohio; Dennis C. Coon, Erie, Pa.

[73] Assignee: Hill-Rom, Inc., Batesville, Ind.

[21] Appl. No.: 09/050,576

[22] Filed: Mar. 30, 1998

Related U.S. Application Data

[60] Provisional application No. 60/079,667, Mar. 27, 1998.

[51] Int. Cl.[7] ..... F21V 23/04

[52] U.S. Cl. ..... 362/251; 362/250; 362/426; 362/804

[58] Field of Search ..... 362/295, 251, 362/426, 370, 371, 804, 802, 250

[56] References Cited

U.S. PATENT DOCUMENTS

| | | | |
|---|---|---|---|
| 2,173,325 | 9/1939 | Alexander . | |
| 2,215,531 | 9/1940 | Pieper . | |
| 2,297,781 | 10/1942 | Korengold . | |
| 3,010,013 | 11/1961 | Gunther et al. . | |
| 3,075,071 | 1/1963 | Lauterbach . | |
| 3,201,582 | 8/1965 | Siegel . | |
| 3,360,640 | 12/1967 | Seitz et al. . | |
| 4,032,771 | 6/1977 | Ilzig . | |
| 4,204,275 | 5/1980 | Lüderitz . | |
| 4,581,689 | 4/1986 | Oram | 362/804 X |
| 5,025,359 | 6/1991 | Saluja et al. . | |
| 5,093,769 | 3/1992 | Luntsford . | |
| 5,165,786 | 11/1992 | Hubert | 362/804 X |
| 5,272,608 | 12/1993 | Engle . | |
| 5,347,431 | 9/1994 | Blackwell et al. . | |
| 5,383,105 | 1/1995 | Agut | 362/804 X |
| 5,539,626 | 7/1996 | Scholz . | |

FOREIGN PATENT DOCUMENTS

| | | |
|---|---|---|
| 1.241.989 | 12/1960 | France . |
| 43 35 254 | 12/1994 | Germany . |

OTHER PUBLICATIONS berchtold Corporation, "Chromophare® C–571 Superior lighting technology is the secret to our success", Feb. 1995, 8 pages.

Berchtold Corporation, "Chromophare® C–570 Service Manual", date unknown, 20 pages.

Patent Cooperation Treaty, Notification of Transmittal of the International Search Report or the Declaration, Jul. 14, 1999, 6 pages.

*Primary Examiner*—Stephen Husar

*Attorney, Agent, or Firm*—Barnes & Thornburg

[57] ABSTRACT

A surgical light apparatus includes a support arm assembly configured to couple a lighthead to a support surface such as a ceiling, a wall, or a stand. The arm assembly includes an upper arm, a lower arm pivotably coupled to the upper arm and a yolk coupled to the lower arm. The lighthead is pivotable with respect to the yolk which includes a task light. The task light coupled to the yolk assembly provides an auxiliary light source for the room when the surgical light is not in use.

19 Claims, 3 Drawing Sheets

TASK LIGHT FOR A SURGICAL LIGHT APPARATUS

This application claims the benefit of U.S. Provisional Ser. No. 60/079,667 filed Mar. 27, 1998.

BACKGROUND AND SUMMARY OF THE INVENTION

The present invention relates to a surgical light apparatus. More particularly, the present invention relates to a surgical light apparatus having a separate task light.

Surgical lights used in hospital operating rooms to illuminate surgical sites on patients are known. Many surgical lights are suspended from a ceiling, wall, or stand in a hospital room by arm mechanisms which are movable to permit adjustment of the location of the surgical light relative to the patient. It is common for surgical lights to be placed in a position behind a surgeon such that the surgeon's head is located between the surgical light and the surgical site. Surgical lights having a dome-shaped reflector to reflect light toward the surgical site around the head of the surgeon are known. It is desirable for surgical lights to provide a high illuminance level, to shine light deeply into a patient's body cavity, and to resist shadowing caused by interference from personnel and instruments.

It is also known to provide a surgical light having a main light source located within a light housing and having additional lamps mounted on the light housing which provide auxiliary light beams in an opposite direction from the main light source. See U.S. Pat. No. 5,539,626. In the of the '626 patent, power is alternately supplied to the main light source and the auxiliary light sources through a change-over switch.

The surgical light apparatus of the present invention provides the improved structure over such known surgical lights which mount auxiliary lights directly to a lighthead housing. The present invention permits a profile size of the lighthead to be as small as possible while still providing benefits of auxiliary lighting for the room. In addition, mounting an auxiliary light source on the lighthead housing may reduce heat dissipation capabilities of the lighthead.

The surgical light apparatus of the present invention includes a support arm assembly configured to couple the lighthead to a support surface, such as a ceiling, a wall, or a stand. Illustratively, the arm assembly includes an upper arm, a lower arm pivotably coupled to the upper arm, and a yolk pivotably coupled to the lower arm. The lighthead is pivotable with respect to the yolk so that the location of the lighthead relative to the surgical site is adjustable to a plurality of different positions.

The surgical light apparatus of the present invention includes a task light mounted on the support arm assembly to provide an auxiliary light source for the room when the surgical light is not in use. Illustratively, the task light is coupled to the yolk of the arm assembly. Controls for the task light are mounted on an opposite side of the yolk from the task light. In addition, separate controls for the task light may be mounted on a control box spaced apart from the surgical light, if desired.

The task light and controls of the present invention are located in a small area on the support arm, spaced apart from the lighthead, to facilitate installation of the task light and task light controls. Therefore, the surgical light can be sold with the task light as a separate option since the housing of the lighthead is not specially modified to receive an auxiliary light such as in known surgical lights.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
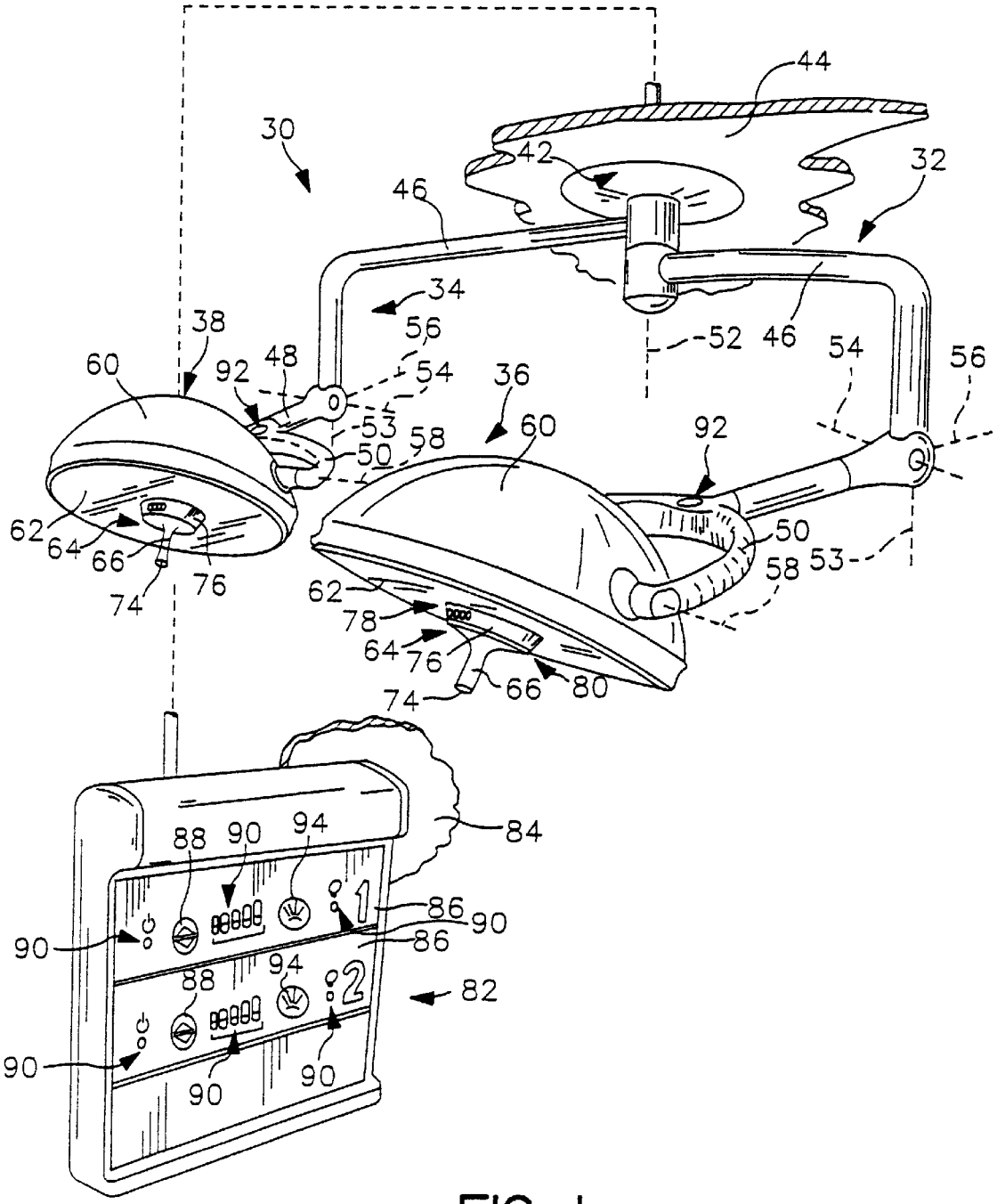
FIG. 1 is a perspective view of a surgical light system in accordance with the present invention showing a first surgical lighthead suspended from a ceiling of a hospital room by a first arm assembly, a second surgical lighthead suspended from the ceiling of the hospital room by a second arm assembly, and a light-controller box mounted to a wall of the hospital room.

A surgical light system 30 includes a first arm assembly 32, a second arm assembly 34, a first lighthead 36 coupled to first arm assembly 32, and a second lighthead 38 coupled to second arm assembly 34 as shown in FIG. 1. First and second arm assemblies 32, 34 each couple to a common mounting apparatus 42 which is configured to mount to suitable support structure (not shown) associated with a ceiling 44. It is understood that the first and second lightheads 36, 38 may be mounted to any suitable support structure such as on a wall or separate stand. Each arm assembly 32, 34 includes an L-shaped upper arm 46, a lower arm 48, and a yoke 50. Each upper arm 46 is independently pivotable relative to mounting apparatus 42 about a vertical pivot axis 52. Each lower arm 48 is pivotable relative to the respective upper arm 46 about a respective horizontal pivot axis 54 and about a respective vertical pivot axis 53 that is spaced from pivot axis 52. In addition, each yoke 50 is pivotable relative to the respective lower arm 48 about a respective pivot axis 56 and each of lightheads 36, 38 is pivotable relative to the respective yoke 50 about a respective pivot axis 58. Thus, arm assemblies 32, 34 and lightheads 36, 38 are movable to a variety of positions relative to ceiling 44.

Figure 2:
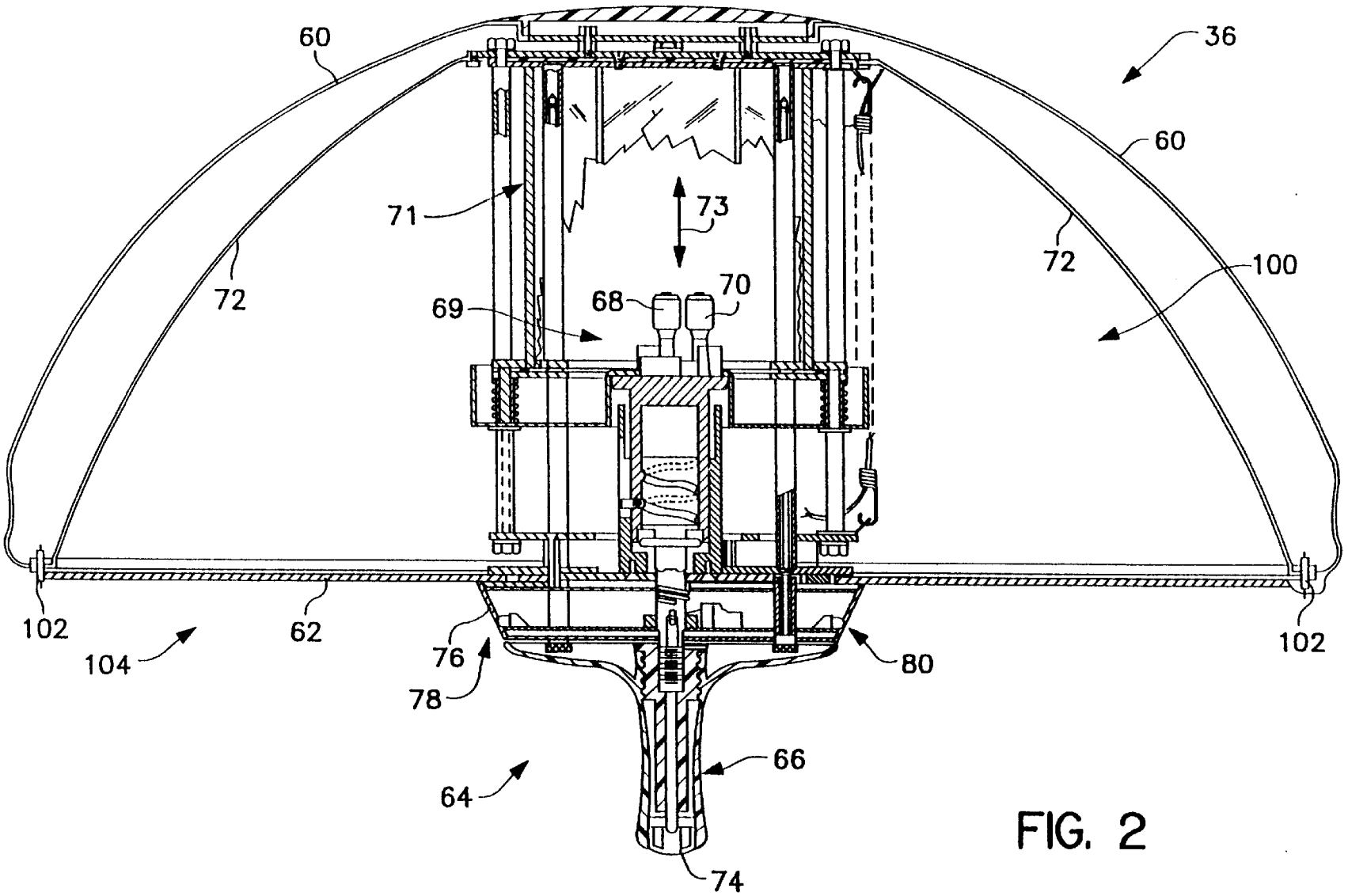
FIG. 2 is a sectional view taken through the first surgical lighthead of FIG. 1 showing a dome-shaped outer cover, a dome-shaped reflector surrounded by the outer cover, a lens coupled to the outer cover, a lamp assembly surrounded by the reflector and lens, and a handle assembly coupled to the lamp assembly.

Each lighthead 36, 38 includes a dome-shaped housing 60, a lens 62 through which light shines from the respective lighthead 36, 38, and a handle assembly 64 as shown in FIG. 1. Each handle assembly 64 includes a handle 66 which is grasped by a surgeon to move the respective lighthead 36, 38 and associated arm assembly 32, 34 to a desired position. Each lighthead 36, 38 includes a lamp assembly 69 having a main light bulb 68 and a redundant or auxiliary light bulb 70 as shown in FIG. 2 with reference to surgical lighthead 36. In addition, each lighthead 36, 38 includes a reflector 72 that reflects light emanating from either bulb 68 or bulb 70 to illuminate a surgical site on a patient. Auxiliary bulb 70 remains in an off state until main light bulb 68 burns out and then auxiliary bulb 70 turns on automatically. Thus, only one of bulbs 68, 70 is on at any instance in time when surgical light system 30 is in use. Each lighthead 36, 38 also includes a light absorption filter apparatus 71 as shown in FIG. 2 with reference to surgical lighthead 36. Light absorption filter 71 is fabricated from specially formulated glass which filters most of the near and intermediate infrared emissions from either of bulbs 68, 70.

The description below of lighthead 36 and the operation of lighthead 36 applies as well to lighthead 38 and the operation of lighthead 38 unless specifically noted otherwise. In addition, although surgical light system 30 includes two arm assemblies 32, 34 and two lightheads 36, 38 as shown in FIG. 1, it is within the scope of the invention as presently perceived for a different number of arm assemblies and corresponding lightheads to be provided. For example, a surgical light system having only one arm assembly and one corresponding lighthead and a surgical light system having three or more arm assemblies and three or more corresponding lightheads are possible.

Handle 66 of each handle assembly 64 is rotatable to move main light bulb 68 and auxiliary light bulb 70 up and down relative to reflector 72 as illustrated by double headed arrow 73 in FIG. 2 to adjust the pattern size of reflected light that illuminates the surgical site. The pattern size may be thought of generally as the diameter of the area illuminated by the associated lighthead 36, 38. In addition, handle assembly 64 includes a button 74 at the bottom of handle 66 which is pressed to adjust the intensity level at which light emanates from bulbs 68, 70. Handle assembly 64 includes an escutcheon or light core panel 76 located above handle 66. Handle assembly 64 further includes a first set of LED's 78 and a second set of LED's 80 that are visible on respective sides of panel 76 to provide user information regarding whether one of bulbs 68, 70 is in use or in a standby mode, whether auxiliary bulb 70 or main bulb 68 is the operative bulb, and the intensity level at which light is emanating from the operative one of bulbs 68, 70. In preferred embodiments, bulbs 68, 70 are each tungsten halogen lamps.

Surgical light system 30 includes a controller box 82, shown in FIG. 1, which is mounted to a wall 84 or other suitable structure and which is coupled electrically to surgical lightheads 36, 38 to control the operation of bulbs 68, 70. Controller box 82 includes a control panel 86 having buttons 88 and sets of LED's 90 that are associated with each respective lighthead 36, 38. Each set of LED's 90 are arranged similarly and provide the same information as LED's 78, 80 of the respective lighthead 36, 38. In addition, each button 86 is pressed to change the light intensity of respective bulbs 68, 70 in the same manner that button 74 of the associated lighthead 36, 38 is pressed to change the light intensity of bulbs 68, 70. Thus, the operation of bulbs 68, 70 is controllable either with the respective handle assembly 64 or controller box 82.

Other features of surgical light system 30 are discussed and shown in detail in co-pending patents and patent applications Ser. No. 09/050,265 entitled Reflector for Surgical Light Apparatus; U.S. Pat. No. 6,012,821 entitled Support Arm for a Surgical Light Apparatus; Ser. No. 09/050,529 entitled Surgical Lighting Apparatus with Improved Cooling; Ser. No. 29/085,726 entitled Surgical Light Apparatus; Ser. No. 09/050,534 entitled Controls for a Surgical Light Apparatus; U.S. Pat. No. D421,148 entitled Handle for a Surgical Lighthead; and U.S. Pat. No. D421,507 entitled Surgical Lighthead Cover all filed concurrently herewith, and all of which are incorporated herein by reference.

Referring to FIG. 2, the surgical lighthead 36 defines an interior region or enclosure 100 between lens 62 and reflector 72. Lens 62 and reflector 72 are coupled to outer housing 60 by suitable fasteners 102. Since the surgical light apparatus of the present invention is used in a surgical suite during a surgical procedure, a sterile field must be provided on the lighthead 36. The sterile field 104 shown in FIG. 2 is typically the area of lens 62 and handle assembly 64. Sterile field 104 may be maintained by wiping or cleaning the lens 62 and by sterilizing the handle assembly through cleaning or autoclaving and by providing a disposable, sterile cover or shield over the handle.

Surgical light system 30 optionally may include a task light 92, shown in FIGS. 1 and 3–5. Controller box 82 optionally may include a button 94 that is pressed to turn task light 92 on and off. The yolk 50 of arm assembly 32 includes a central hub 106 pivotably mounted to lower arm 48. Yolk 50 further includes arms 108 extending away from the hub 106. Distal ends of the arms 108 are coupled to housing 60 of the surgical lighthead 36 by suitable connectors 110.

Figure 3:
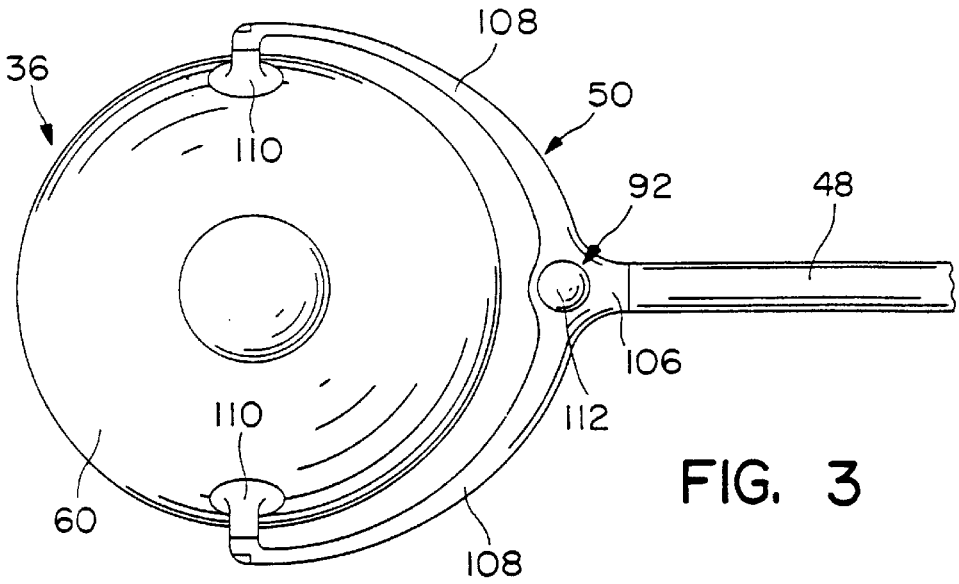
FIG. 3 is a top view of the first surgical lighthead and arm assembly further illustrating the location of a task light on the arm assembly.
Figure 4:
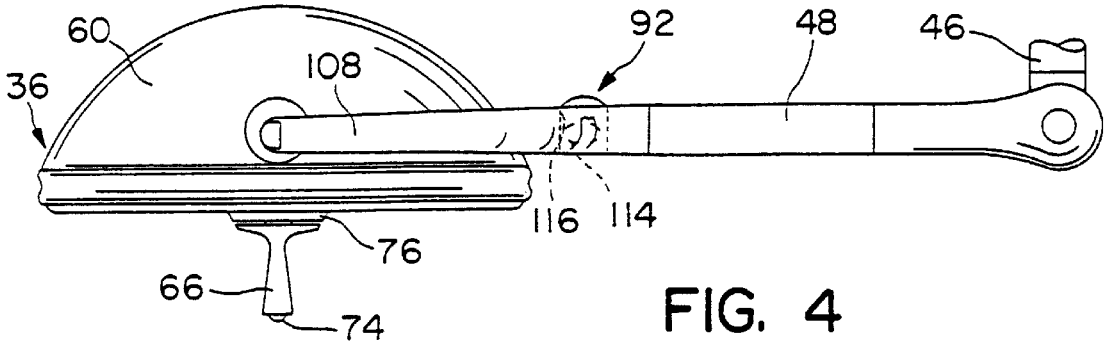
FIG. 4 is a side elevational view of FIG. 3.
Figure 5:
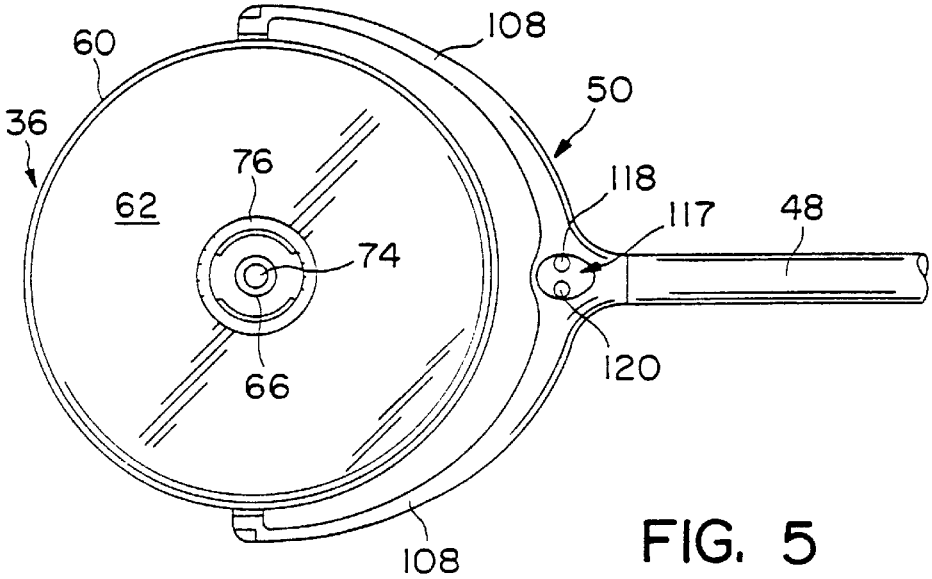
FIG. 5 is a bottom view of the lighthead and arm assembly illustrating controls for the task light and the surgical light.

As shown in FIGS. 3–5, the task light 92 is mounted on the hub 106 of the yolk 50 spaced apart from the housing 60 of lighthead 36. This mounting position for the task light 92 permits the lighthead to be free from additional items so that a profile or size of the lighthead 36 can be maintained as small as possible. Therefore, the lighthead is not in the way during the surgical procedure. In addition, housing 60 provides a heat dissipating area which is free from any extra structural components which could reduce the heat dissipating effect.

Mounting the task light 92 on the yolk 50 facilitates providing the task light 92 as an optional item. If the lighthead housing 60 were specially formed for the task light 92, it would be difficult not to include the task light with the housing 60. The yolk 50 can be quickly modified for receiving the task light 92 if the option is selected. Since control wires already run through the arm assembly 32, an opening can be formed at the desired location for mounting the task light 92.

A dome cover 112 is mounted on a top side of the yolk 50 as shown in FIGS. 3 and 4. A task light bulb 114 is located within an interior opening 116 formed in yolk 50. Controls 117 for the task light bulb 114 are mounted on a bottom surface of the yolk 50 as illustrated in FIG. 5. The illustrated controls 117 include a first push button 118 for turning the task light 92 on and a second push button 120 for turning the task light 92 off. In addition, the actuator button 94 on control box 92 can be used to turn the task light 92 on and off.

Although the invention has been described in detail with reference to a certain illustrated embodiment, variations and modifications exist within the scope and spirit of the invention as described and as defined in the following claims.

What is claimed is:

1. A surgical light apparatus comprising:

a lighthead having a main light source;

an arm assembly coupled to the lighthead, the arm assembly being configured to mount the lighthead on a support; and a task light coupled to the arm assembly between the lighthead and the support.

2. The apparatus of claim 1, further comprising a control switch coupled to the arm assembly for turning the task light on and off.

3. The apparatus of claim 2, further comprising a second control switch mounted at a remote location spaced apart from the arm assembly, the second control switch also being configured to turn the task light on and off.

4. The apparatus of claim 1, wherein the arm assembly includes a yolk pivotably coupled to the lighthead, the task light being coupled to the yolk.

5. The apparatus of claim 4, wherein the task light includes a bulb configured to emit light in a direction away from a top surface of the yolk, and further comprising a control switch mounted on a bottom surface of the yolk for turning the task light on and off.

6. The apparatus of claim 4, wherein the arm assembly further includes a first arm segment pivotably coupled to the yolk and a second arm segment pivotably coupled to the first arm segment.

7. The apparatus of claim 1, further comprising a handle coupled to the lighthead, the handle being formed to include an actuator for adjusting an intensity of the main light source within the lighthead.

8. The apparatus of claim 7, wherein the actuator also turns the main light source on and off.

9. The apparatus of claim 7, wherein the actuator is located within a sterile field of the lighthead.

10. A surgical light apparatus comprising:

a lighthead having a main light source;

an arm assembly coupled to the lighthead, the arm assembly being configured to mount the lighthead on a support;

a task light coupled to the arm assembly;

a control switch coupled to the arm assembly for turning the task light on and off; and a second control switch mounted at a remote location spaced apart from the arm assembly, the second control switch also being configured to turn the task light on and off.

11. The apparatus of claim 10, wherein the arm assembly includes a yolk pivotably coupled to the lighthead, the task light being coupled to the yolk.

12. The apparatus of claim 10, further comprising a handle coupled to the lighthead, the handle being formed to include an actuator for adjusting an intensity of the main light source within the lighthead.

13. The apparatus of claim 12, wherein the actuator also turns the main light source on and off.

14. The apparatus of claim 12, wherein the actuator is located within a sterile field of the lighthead.

15. A surgical light apparatus comprising:

a lighthead having a main light source;

an arm assembly coupled to the lighthead, the arm assembly being configured to mount the lighthead on a support;

a task light coupled to the arm assembly, the arm assembly including a yolk pivotably coupled to the lighthead, the task light being coupled to the yolk, the task light including a bulb configured to emit light in a direction away from a top surface of the yolk; and a control switch mounted on a bottom surface of the yolk for turning the task light on and off.

16. The apparatus of claim 15, wherein the arm assembly further includes a first arm segment pivotably coupled to the yolk and a second arm segment pivotably coupled to the first arm segment.

17. The apparatus of claim 15, further comprising a handle coupled to the lighthead, the handle being formed to include an actuator for adjusting an intensity of the main light source within the lighthead.

18. The apparatus of claim 17, wherein the actuator also turns the main light source on and off.

19. The apparatus of claim 17, wherein the actuator is located within a sterile field of the lighthead.

* * * * *